United States Patent [19]

Hirabayashi

[11] Patent Number: 4,524,899

[45] Date of Patent: Jun. 25, 1985

[54] METHOD OF MANUFACTURING VENT ELEMENT

[75] Inventor: Masao Hirabayashi, Kawagoe, Japan

[73] Assignee: Tokyo Sintered Metal Co., Ltd., Tokyo, Japan

[21] Appl. No.: 366,694

[22] Filed: Apr. 8, 1982

[30] Foreign Application Priority Data

| | | | |
|---|---|---|---|
| Jul. 31, 1981 | [JP] | Japan | 56-119283 |
| Jul. 31, 1981 | [JP] | Japan | 56-119284 |
| Jul. 31, 1981 | [JP] | Japan | 56-119285 |
| Dec. 24, 1981 | [JP] | Japan | 56-208037 |

[51] Int. Cl.[3] ..... B21D 39/04

[52] U.S. Cl. ..... 228/173.2; 29/163.5 R; 29/423; 29/456; 29/527.5; 156/173; 164/107; 228/174; 228/247; 401/209

[58] Field of Search ..... 29/527.5, 456, 163.5 CW, 29/469.5, 163.5 F, 423, 163.5 R; 264/221, 263, 317, 320, 322, DIG. 44; 156/173; 148/24; 228/173 E, 173 R, 245, 246, 247, 173 A, 174; 401/209, 216; 164/106, 107, 111; 242/7.21, 7.22

[56] References Cited

U.S. PATENT DOCUMENTS

| | | | |
|---|---|---|---|
| 2,093,810 | 9/1937 | Karmazin | 228/245 X |
| 2,499,977 | 3/1950 | Scott | 29/163.5 R X |
| 2,619,438 | 11/1952 | Varian | 29/163.5 R X |
| 2,961,758 | 11/1960 | Slayter | 29/163.5 R X |
| 3,319,318 | 5/1967 | Taimuty | 29/163.5 R X |
| 3,904,297 | 9/1975 | Hori | 401/209 X |
| 4,166,564 | 9/1979 | Wolber | 29/163.5 F X |

OTHER PUBLICATIONS

IBM, "A Self-Releasing, Disposable Mold Fabrication Process", E. A. Bartkus, J. M. Brownlow and K. R. Grebe, vol. 7, No. 5, Oct. 1964.

Preparation of Ceramic Forms Using a Removable Mandrel, C. S. Morgan, J. I. Federer and V. J. Tennery, vol. 54, No. 9, 1975.

*Primary Examiner*—Howard N. Goldberg
*Assistant Examiner*—Joseph M. Gorski
*Attorney, Agent, or Firm*—Young & Thompson

[57] ABSTRACT

A method of manufacturing a vent element having vent pores extending therethrough in parallel with the axial direction for use in die casting, rubber and plastic molding, metering and supplying of fluids, a ball-point pen and others. The method comprises winding one or more wire rods consisting of metal, ceramics or a compound material thereof having a melting point higher than that of a core rod in the form of a single or plural layer spirally around the core rod to form a secondary wire rod, heating the secondary wire rod or a bundle of a plurality of the secondary wire rods to a temperature which exceeds the melting point of the core rod but does not melt the wire rod so as to melt the core rod, whereby the melt is infiltrated into the interspaces between the wire rods and/or the windings of the wire rod to form one pore at every position where the core rod was.

5 Claims, 6 Drawing Figures

METHOD OF MANUFACTURING VENT ELEMENT

BACKGROUND OF THE INVENTION

1. Field of the Invention

This invention relates to a method of manufacturing a vent element, particularly an element having vent pores extending therethrough in parallel with the axial direction and having a comparatively uniform pore diameter, such as a vent for use in metal casting, die casting and rubber and plastic molding, a wear-resistant seat element, metering and supplying a liquid and a heat exchanger element.

2. Description of the Prior Art

There have hitherto been known many methods of manufacturing this kind of vent element, such as methods of drill machining, laser working, electro spark working, bundling and integrating metal tubes or sintering and infiltrating wire rods positioned in a compacted powder.

The methods of drill machining, laser working or electro spark working, however, are limited in thickness of the vent element and require a large amount of machining cost for forming a number of pores so that these methods are impractical. In the method of bundling metal tubes, the pore ratio is remarkably large if special thick tubes are not used, so that this method is limited in use. This bundling method also proposes to fill the interspaces between the tubes with an infiltrated metal or the like, but it is extremely difficult to manufacture it in practice. Besides, the sintering and infiltrating method can adjust a pore diameter and its ratio by selecting the outer diameter and the number of wire rod to be used, but requires large scale facilities for uniformly distributing and arranging wire rods, and the pore ratio becomes lessened.

SUMMARY OF THE INVENTION

An object of the invention is to eliminate disadvantages in the prior methods and to provide a vent element having vent pores extending therethrough in the axial direction and having comparatively uniform pore diameter easily and cheaply.

Another object of the invention is to provide a method of manufacturing a vent element for optionally setting a remarkably large pore ratio as compared with the prior art which uses a sintered compact as a matrix.

A further object of the invention is to provide a method of manufacturing a vent element having linearly extended pores with small pore dimeter and high porosity usable for efficiently venting in casting or die casting of metal and in molding of rubber and plastics.

A still further object of the invention is to provide a method of manufacturing a vent element usable as a wear-resisting seat for a ball-point pen by infiltrating a core rod into interspaces between the formed pores.

Another object of the invention is to provide a method of manufacturing a vent element usable as a heat exchanger element between fluid paths by using wire rods having good conductivity as a winding to form the wall around a fluid path formed by the pore.

In order to attain the above objects, the invention is characterized by a method of manufacturing a vent element comprising winding one or more than two wire rods consisting of metal, ceramics or a compound material thereof having a melting point higher than that of a core rod in the form of a single or plural layer spirally around said core rod to form a secondary wire rod, heating said secondary wire rod or a bundle of a plurality of said secondary wire rods to a temperature which exceeds the melting point of the core rod but does not melt the wire rod so as to melt the core rod, whereby the melt is infiltrated into the interspaces between the wire rods and/or the windings of the wire rod to form one pore at every position where the core rod is existent.

DESCRIPTION OF THE PREFERRED EMBODIMENTS

The invention will be explained with reference to the accompanying drawings.

Figure 1:
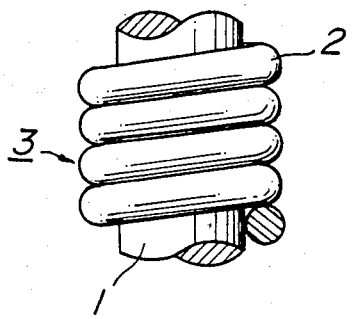
FIG. 1 is a partial side view of a secondary wire rod.
Figure 2:
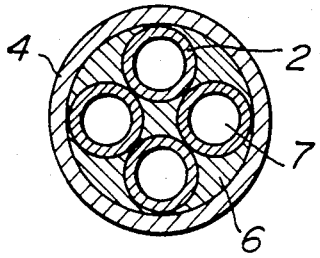
FIGS. 2 and 3 are cross-sectional views showing two embodiments of a vent element manufactured by the invention.
Figure 3:
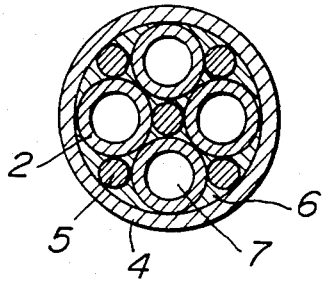
Figure 4:
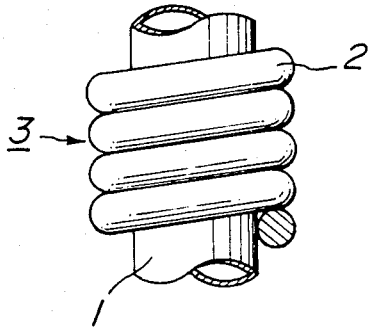
FIG. 4 is a partial side view of a secondary wire rod which core rod is tubular.

A core rod 1 is composed of a linear solid rod or hollow tube made of metal or ceramics such as glass. Around the periphery of the core rod 1, as shown in FIG. 1, are would one or more wire rods 2 made of metal, ceramic or a compound material thereof having a melting point higher than that of the core rod in the form of a single layer or a plurality of layers to form a secondary wire rod 3. A plurality of the secondary wire rods 3 are combined and inserted in a tubular element 4, or if necessary, as shown in FIG. 3, are combined together with another one or more wire rods 5 which are not melted by heating, inserted in the hollow tubular element 4. The thus-bundled secondary wire rods are heated to melt the core rods only. The melt is infiltrated into interspaces 6 between windings of the secondary wire rods or between the rods and solidified to combine integrally so that a pore 7 is formed at every core rod portion. In case of bundling the secondary wire rods 3, the strength is increased and the outer wall surface is smoothed by inserting the secondary wire rod into the hollow tubular element 4 and integrally combined them by heating, whereby the external appearance is improved and the pores are uniformly distributed and maintained. In addition, after insertion into the hollow tubular element 4, and plastic working such swaging or drawing is applied, the interspaces between the wire rods are reduced and the cross-sectional area of the core rod can optionally be adjusted. If the whole melt of the molten core rod is not absorbed in the interspaces of the wire rods, the melt does not flow out the core rod portions and the pores to be formed in the core rod portions are partly closed. In order to prevent such problems a hollow tube 1 may be used as a core rod as shown in FIG. 4, to decrease the amount of the melt. In the case of using a hollow tube 1 as the core rod, plastics or organic material which is burnt or decomposed and disappears at the heating temperature may be filled within the inner bore of the hollow tube 1 so as to prevent the secondary wire rod from deforming during the plastic working.

As the material of the core rod, use may be made of copper and copper alloys thereof, silver, tin, lead, zinc or alloy, and ceramics such as glass. As the material of the wire rod, use may be made of copper and copper alloy, iron, stainless steel, Ni and its alloys, Ti, Ta, W and the like. For the purpose of obtaining good conductivity, in case of using silver alloy as a core rod and copper as a wire rod, a problem is caused by melting the alloy into a wire rod, producing flow of the formed alloy and clogging the pore. In this case, therefore, it is possible to completely absorb the core rod melt by using a composite wire rod formed with a heterogeneous metal layer such as nickel plating on the surface of a copper wire rod.

If wire rod 5 is made of a hard material such as boron nitride, silicon carbide or the like and is bundled with the secondary wire rod in parallel, it is possible to form a seat surface having wear resistance on the end surface. Furthermore, when carbon fibers and molybdenum fibers are simultaneously bundled, a surface having good lubricating properties can be provide on the end surface of the vent element. Lubricating properties can also be improved by a surface treatment such as nitride treatment, ion plating or the like.

Figure 5:
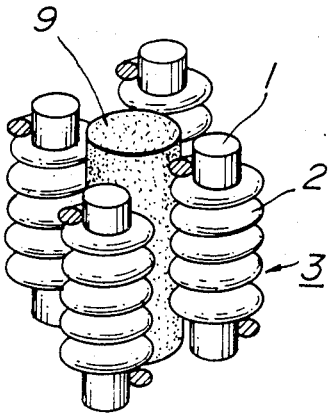
FIG. 5 is a perspective view showing an embodiment of a bundle of secondary wire rods with a porous rod arranged at the central position according to the invention.

As shown in FIG. 5, adjustment in accordance with use is also possible by bundling with a porous element 9 which can absorb excessive melt.

Figure 6:
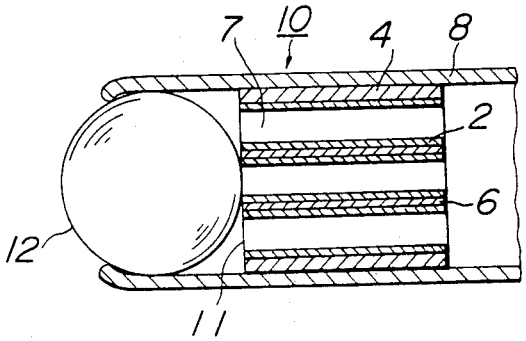
FIG. 6 is a cross-sectional view of a ball seat element manufactured by the invention.

FIG. 6 shows a ball seat element for a ball-point pen produced according to the present invention. A plurality of the secondary wire rods 3 prepared as mentioned above are inserted into the tube 4 to form a bundle. The bundle is heated to said temperature which exceeds the melting point of the core rod but does not melt the wire rod 2 wound around the core rod to melt it. The melt core rod material infiltrates into the interspaces 6 between the wire rods and the windings of the wire rods to form vent pores 7 at every core rod portion. The end surface of the vent element 10 thus produced is used as a flat shape or can be punched into a semi-spherical shape to provide a wear-resistant seat 11.

It is also possible to produce a vent element by bundling ceramic fibers in parallel and retaining the ceramic fibers in a part of the vent element by heating.

EXAMPLE 1

A metal wire of 0.15 mm in diameter having a composition consisting of 30% copper, 8% tin, 0.5% nickel and the remainder silver in weight ratio was used as a core rod, and a SUS 316 stainless steel wire rod of 0.1 mm outer diameter, was tightly wound in a single layer around the outer periphery of the core rod to form a secondary wire rod. Twenty-two secondary wire rods thus prepared were bundled into one bundle, inserted into a SUS 316 stainless steel tube of 2.8 mm inner diameter and 3.0 mm outer diameter. After reducing the outer diameter of the outer tube to 1.9 mm by swaging, the secondary wire rods were held in an atmosphere of dissociated ammonia gas at 1,250° C. for 60 minutes, to sinter them and cause infiltration. As a result, a filtering vent element having 22 linear vent pores of 0.11 mm diameter was obtained. The thus-obtained filtering vent element had porosity of 7%.

EXAMPLE 2

A metal wire of the same quality as in Example 1 was used as a core wire, and a single layer of a SUS 316 stainless steel wire rod of 0.07 mm outer diameter was wound around the outer periphery of the core wire to form a secondary wire rod. Seventeen secondary wire rods thus prepared were inserted into a SUS 316 stainless steel tube of 1.5 mm inner diameter and 1.8 mm outer diameter, and the composite was held in an atmosphere of dissociated ammonia gas at 1,250° C. for 60 minutes, to effect sintering and infiltration. As a result, a filtering vent element having 17 vent pores of 0.15 mm diameter was obtained. The obtained filtering vent element had porosity of 25%.

EXAMPLE 3

A copper wire of 0.5 mm outer diameter and 100 mm length was used as a core rod, and one layer of a SUS 304 stainless steel wire rod of 0.2 mm outer diameter was wound around the copper core rod to form a secondary wire rod. Seventy such secondary wire rods were inserted into a SUS 304 stainless steel tube of 17 mm outer diameter and 12 mm inner diameter, and at the same time, a porous SUS 304 stainless steel rod of 5 mm outer diameter, 100 mm length and of 80% porosity was inserted into the steel tube at about the central position thereof to form a bundle. Then, the outer diameter of this bundle was reduced to 13 mm by swaging, and the composite was heated in a hydrogen gas atmosphere at 1,200° C. for 15 minutes and cooled in the furnace. As a result, a vent element having 70 vent pores of 0.47 mm diameter and porosity of 32% was obtained. As a comparative example, the same element was manufactured under the same conditions, except that the porous rod was not inserted into the central portion. As a result, the pores was clogged and porosity was very low.

EXAMPLE 4

A copper tube of 0.5 mm outer diameter, 0.05 mm thickness and 100 mm length was used as a core rod, around which was wound an iron wire of 0.2 mm outer diameter to form a secondary wire rod. One hundred twenty-five such secondary wire rods were filled within an iron pipe of 20 mm outer diameter and 2.5 mm thickness, then the outer diameter was reduced to 15 mm by drawing. Thereafter, the iron pipe was held in vacuo at 1,200° C. for 5 minutes and cooled. A vent element having vent pores of 0.47 mm diameter and a porosity of 36% was obtained.

EXAMPLE 5

A silver alloy (72% Ag, 28% Cu) wire of 0.07 mm outer diameter was used as a core wire, around which were alternately wound a titanium wire and a molybdenum wire each of which had an outer diameter of 0.05 mm to form a secondary wire rod. Into a titanium tube of 0.8 mm inner diameter and 0.07 mm thickness were inserted 7 such secondary wire rods combined with an SiC wire of 0.05 mm outer diameter. The outer diameter of this tube was reduced to 0.7 mm by drawing, cut into 14 mm lengths, a part thereof was cut to 0.5 mm depth by means of a drill of 0.5 mm outer diameter by retaining the outer tube portion, and at the same time, the end surface was worked into a semi-spherical surface. Then, it was heated in vacuo at 1,150° C., and held at that temperature for 1 hour to melt the core wire and to infiltrate it into the wire portion, so as to form a columnar body. On the spherical surface of the columnar body was placed a ruby ball of 0.6 mm outer diameter, the ball being retained by the end of a projected tubular body to form a ball-point pen tip.

EXAMPLE 6

A similar alloy wire of 0.07 mm outer diameter was used as a core rod, around which was wound a SUS 316 stainless steel wire having an outer diameter of 0.05 mm to form a secondary wire rod. Into a SUS 316 stainless steel tube of 0.8 inner diameter and 0.07 mm wall thickness were inserted 7 such secondary wire rods together with a Mo wire rod of 0.05 mm outer diameter at the center position. After the outer diameter of this tube was reduced to 0.7 mm by drawing, the tube was cut into 14 mm lengths.

The cut tube was inserted into a SUS 316 stainless steel outer tube of 0.7 mm inner diameter, 0.25 mm wall thickness and 20 mm length. Then, it was heated in vacuo at 1,150° C., and held at that temperature for 1 hour to melt the core rods. Thus the core rods was infiltrated and/or diffused into the interspaces between the stainless steel wires of the secondary wire rods and the windings thereof as well as the inner and outer stainless steel tubes so as to form straight pores at the core rod positions and combine the stainless steel wires, and Mo wire rod and the inner and outer stainless steel tubes integrally to provide a seat element within the outer tube. A ruby ball of 0.5 mm outer diameter was inserted into one end of the outer tube in such a manner that the inside spherical surface of the ruby ball is seated on the flat end surface of the seat element and the outside spherical surface projects from the end of the outer tube and then the end of the outer tube was rolled so as to retain the ruby ball in the position to provide a ball-point pen tip.

EXAMPLE 7

A silver alloy (72% Ag, 25% Cu) wire of 0.08 mm in outer diameter was used as a core rod, around which was wound a SUS 316 stainless steel wire having an outer diameter of 0.07 mm to form a secondary wire rod. Into a SUS 316 stainless steel tube of 0.65 mm inner diameter, 0.8 mm outer diameter and 1,000 mm length were inserted 4 such secondary wire rods. After the outer diameter of this tube was reduced to 0.6 mm lengths by drawing, the tube was cut into 1 mm. This cut tube was formed at one end thereof with a recess of 20$\mu$ depth by use of a punch having a tip of 0.5 mm diameter. Then, into a SUS 304 stainless outer tube of 0.6 mm inner diameter, 0.85 mm outer diameter and 20 mm length and having one end reduced by spinforming were inserted a ruby ball of 0.5 mm outer diameter and the cut tube from the other end of the outer tube in such a manner that the ruby ball is retained by the spun end of the outer tube to project a part of the spherical surface of the ball from the spun end and is seated on the recessed end surface of the cut tube.

Then, it was heated in vacuo at 1,150° C., and held at that temperature for 5 minutes to melt the core rods. Thus the core rods were infiltrated into the interspaces between the stainless steel wires of the secondary wire rods and the windings thereof as well as the inner and outer stainless steel tubes so as to form straight pores at the core rod positions and to combine the stainless steel wires and the inner and outer stainless steel tubes integrally to provide a ball-point pen tip.

EXAMPLE 8

A wire of silver alloy (60% Ag, 30% Cu and 10% Sn in weight ratio) of 0.3 mm diameter was used as a core rod, around which was tightly wound one layer of nickel-plated copper wire of 0.2 mm diameter to form a secondary wire rod. Two hundred five such secondary wire rods were bundled and twisted to form a twisted wire of 20 mm pitch, and this bundle of secondary wire rods was reduced to 9.8 mm outer diameter and 100 mm length. Then, the bundle was inserted into a copper tube with heat exchanging fins of 40 mm outer diameter of fins, 20 mm root diameter of the fins and 10 mm inner diameter of the tube, and heat treated in a furnace in a hydrogen atmosphere at 1,200° C. for 15 minutes. A vent element with heat exchanging fins having a number of vent pores of 0.28 mm diameter was obtained.

What is claimed is:

1. A method of manufacturing a vent element having a plurality of small pores extending therethrough in parallel, comprising winding at least one wire rod in at least one layer spirally around and in contact with each of a plurality of core rods to form secondary wire rods each having a plurality of windings, said at least one wire rod having a melting point higher than that of said core rods, assembling a plurality of said secondary wire rods into a bundle by inserting the secondary wire rods into a hollow tubular element with interspaces between the secondary wire rods, plastically working the hollow tubular element and the bundle to reduce the diameter of the hollow tubular element and the bundle, and heating the bundle of secondary wire rods to a temperature which exceeds the melting point of the core rods but does not melt the wire rods thereby to melt the core rods, whereupon the molten core rods infiltrate between the windings of the secondary wire rods and also the interspace between the secondary wire rods thereby to bond adjacent windings of each secondary wire rod together, to bond the bundle of secondary wire rods together, to bond the secondary wire rods to the hollow tubular element and to form one pore at every position where a core rod was.

2. A method as claimed in claim 1, in which the core rods are solid.

3. A method as claimed in claim 1, in which the core rods are hollow.

4. A method as claimed in claim 1, and inserting a plurality of wires between and parallel to said secondary wire rods prior to the heating of the bundle, said wires having a melting point higher than said core rods such that said wires do not melt when the core rods melt.

5. A method as claimed in claim 1, and assembling the element with a ball of a ball-point pen in a tube that retains the ball and the vent element in assembled relationship, whereby the vent element serves as an ink supply to the ball of the ballpoint pen.

* * * * *